US006060161A

United States Patent [19]

Aldrich

[11] Patent Number: 6,060,161

[45] Date of Patent: May 9, 2000

[54] PINTLE WIRE

[75] Inventor: William Daniel Aldrich, Wilson, N.C.

[73] Assignee: Scapa Group PLC, Blackburn, United Kingdom

[21] Appl. No.: 09/101,091

[22] PCT Filed: Dec. 27, 1996

[86] PCT No.: PCT/GB96/03255

§ 371 Date: Jul. 14, 1998

§ 102(e) Date: Jul. 14, 1998

[87] PCT Pub. No.: WO97/25474

PCT Pub. Date: Jul. 17, 1997

[30] Foreign Application Priority Data

Jan. 3, 1996 [GB] United Kingdom ..... 9600052

[51] Int. Cl.[7] ..... D01F 6/04; D01F 8/06

[52] U.S. Cl. ..... 428/364; 428/373; 139/420 A

[58] Field of Search ..... 428/373, 364; 139/420 A; 442/200, 311, 199, 373, 374; 24/33 P; 474/255

[56] References Cited

U.S. PATENT DOCUMENTS

| | | | |
|---|---|---|---|
| 4,421,819 | 12/1983 | Baker | 428/229 |
| 4,564,992 | 1/1986 | Lefferts | 29/429 |
| 4,650,709 | 3/1987 | Lefferts | 428/227 |
| 5,015,220 | 5/1991 | Legge et al. | 474/256 |
| 5,169,570 | 12/1992 | Sayer et al. | 264/22 |
| 5,188,884 | 2/1993 | Smith | 428/193 |
| 5,342,567 | 8/1994 | Chen et al. | 264/203 |
| 5,514,438 | 5/1996 | Crook, Jr. | 139/383 A |
| 5,562,968 | 10/1996 | Fry | 428/193 |
| 5,787,936 | 8/1998 | Snipes | 139/383 A |
| 5,819,811 | 10/1998 | Baker et al. | 139/383 A |
| 5,840,637 | 11/1998 | Denton et al. | 442/200 |

FOREIGN PATENT DOCUMENTS

| | | |
|---|---|---|
| 0 695 827 | 2/1996 | European Pat. Off. . |
| 997354 | 7/1965 | United Kingdom . |
| 1 379 211 | 1/1975 | United Kingdom . |

OTHER PUBLICATIONS

Research Disclosure; vol. 386 No. 036, Jun. 10, 1996, Emsworth, GB.

Research Disclosure; vol. 382 No. 011, Feb. 10, 1996 Emsworth, GB.

*Primary Examiner*—Newton Edwards

*Attorney, Agent, or Firm*—Jacobson, Price, Holman & Stern, PLLC

[57] ABSTRACT

A multifilament pintle wire comprises a polyolefin material optionally in combination with another material.

13 Claims, No Drawings

PINTLE WIRE

BACKGROUND OF THE INVENTION

1. Field of the Invention

The present invention relates to a pintle wire, particularly but not exclusively for use in joining the ends of industrial fabrics, such as papermachine clothing, for example press felts and dryer fabrics.

2. Description of the Related Art

It is known to join the ends of an industrial fabric using a monofilament pintle wire so as to provide an endless belt. Each end of the fabric is provided with outwardly extending loops, the two sets of loops being interdigitatable and capable of union by a pintle wire.

These known monofilament pintle wires have a low tensile strength. The wires may additionally have flaws in the monofilament structure. As a result the wires often break on insertion through the tunnel defined by the interdigitated loops. More importantly, the wires may break while the belt is in operation. This may lead to belt damage and necessitate the disposal of the belt before the end of its expected working life. As these belts, particularly those for use in papermaking, are extremely expensive this problem is of considerable importance.

Another problem with these known monofilament pintle wires is that the diameter of the wires are such that they do not fill the loop area and as such result in a high degree of localised permeability. This, once again, is of particular importance in the field of papermaking, where variations in permeability in the belt result in marking of the paper produced on the belt.

As an alternative to monofilament pintle wires multifilament pintle wires comprising polyamide have been used which are resin-treated. The resin treatment involves impregnation with phenolic or epoxy polymer resin which is then cured. Alternatively multifilament pintle wires have been used which comprise polyamide multifilaments wrapped around a polyamide monofilament core. Both of these known structures serve to give the polyamide multifilament a stiffness akin to a monofilament. Resin treatment processes are a burden in terms of increased material costs and production times, as well as being increasingly environmentally unsound due to the fact that treatment with these resins requires a considerable amount of organic solvent. Furthermore polyamides are generally lacking in abrasion resistance.

For dryer fabrics the aramid NOMEX (trade mark) and NOMEX (trade mark)/polyester blends have been used but neither can withstand the high loads present in the nips of a press section.

BRIEF SUMMARY OF THE INVENTION

The present invention has been made from a consideration of these problems.

According to the present invention there is provided a multifilament pintle wire comprising a polyolefin material, optionally in combination with another material, said pintle wire being free of a resin coating.

DETAILED DESCRIPTION OF THE INVENTION

The multifilaments of the invention provide excellent pintle wires (due to the high degree of molecular orientation in the polymer) without the need for any conventional stiffening treatment such as resin-coating or impregnation, or combination with a monofilament, as is the case with prior art multifilament pintles. The individual filaments of the wires of the present invention are generally of the same diameter. However, the multifilament still retains a reasonable degree of flexibility.

Ideally the material which may optionally be combined with the polyolefin does not comprise polyamide.

This polyolefin may be gel-spun, giving a preferred weight average molecular weight of 500000–8000000, especially 1500000–4000000, or melt-spun, giving a preferred weight average molecular weight of 50000–3000000, especially 750000–2000000. The yarns preferably have a tenacity greater than 10 g/denier.

The polyolefin is typically a homo- or copolymer of ethylene or propylene. It may also contain other polyolefin additives (preferably no more than 2 wt. %) having an average molecular weight less than that of the host polyolefin material. Examples of such additives include linear polyethylene; isotactic polypropylene; polybut-1-ene; copolymers of ethylene with but-1-ene, hex-1-ene, (meth) acrylic acid or vinyl acetate; polyethylene grafted with acrylic acid or styrene; and ethylene/propylene rubbers. These additives increase resistance to fibrillation.

The pintle wires of the invention exhibit improved tensile strength and are thus less prone to breaking. Furthermore, the wires exhibit an increased ability to deform to match the configuration of the interdigitated loops and thus have a reduced tendency to mark goods, such as paper sheets which are formed on the belt. The belt further has a reduced tendency to stretch during installation and has increased abrasion resistance. This abrasion resistance is important during insertion of the pintle wire through the tunnel formed by the interdigitated loops and during operation of the belt. The multifilaments are also less likely to damage the interdigitated loops.

The pintle wire may advantageously be inserted into position by first attaching a metal leader at one end thereof and inserting this into the interdigitated loops.

The break strength of the multifilament yarns of the present invention is typically in the order of from 1.5 to 4 N/tex and the tensile strength is typically in the order of from 1 to 4 G Pa.

The multifilament structure of the wire may comprise a cabled, braided or wrapped construction. As only the surface, of the pintle wire needs be abrasion resistant the pintle wire may comprise a core made, for example, from aramid, such as NYLON, and a sheath made from polyolefin. In such cases the pintle wire may comprise as little as 25% by weight polyolefin. Normally the pintle wire comprises at least 40% of polyolefin and usually 50% or more.

The diameter of the pintle wires is preferably in the range from 0.5 mm to 1.1 mm and is ideally in the order of 0.8 mm (0.035"). This may be accomplished using a single or multiple multifilament strand.

Any suitable material may be used in combination with the polyolefin material. The different filaments of the multifilament may be made from the same or different materials. Typical additional materials might include metal, polyester, polyvinyl alcohol or polyamides, such as aramids or nylon.

Preferably the pintle wire solely comprises high molecular weight polyethylene, i.e. molecular weight in the order of $2–6\times10^6$. Ideally gel spun high molecular weight polyethylene is used. This has a good chemical and hydrolysis resistance, particularly against oxidising agents. These yarns are about 40% stronger than p-aramids and have an excellent resistance to chemicals and hydrolysis.

In order to make the gel spun filaments a 1 to 5 wt % solution of ultra high molecular weight polyethylene in a high temperature organic solvent (e.g. decalin or paraffin oil) is extruded and the gelatinous filaments are stretched to several hundred times length at a temperature close to the melting point of the polymer. This yields a polymer with a very high degree of linear polymer orientation and a high degree of crystallisation which accounts for its strength.

Examples of suitable yarn materials include gel-spun high molecular weight polyethylene such as those marketed under the trade marks DYNEEMA, SPECTRA or similar materials that are spun from a polymer melt rather than a gel, such as CERTRAN.

I claim:

1. A multifilament pintle wire comprising a polyolefin material, optionally in combination with another material, said pintle wire being free of a resin coating.

2. A multifilament pintle wire as claimed in claim 1, wherein the individual filaments of the multifilament wire are of the same diameter.

3. A multifilament pintle wire as claimed in claim 1, wherein the said polyolefin has a weight average molecular weight of 500000–8000000.

4. A multifilament pintle wire as claimed in claim 1, wherein the said polyolefin has a weight average molecular weight of 1500000–4000000.

5. A multifilament pintle wire as claimed in claim 1, wherein the said polyolefin has a weight average molecular weight of 50000–3000000.

6. A multifilament pintle wire as claimed in claim 5, wherein the polyolefin has a weight average molecular weight of 750000–2000000.

7. A multifilament wire as claimed in claim 1, wherein the said polyolefin material is a homo- or copolymer of ethylene or propylene.

8. A multifilament pintle wire as claimed in claim 1, wherein the pintle wire comprises any of the following either alone or in combination: linear polyethylene; isostatic polypropylene; polybut-1-ene; copolymers of ethylene with but-1-ene, hex-1-ene, (meth)acrylic acid or vinyl acetate; polyethylene grafted with acrylic acid or styrene; or ethylene/propylene rubbers.

9. A multifilament pintle wire as claimed in claim 1, wherein the break strength of the wire is in the range from 1.5 to 1.4 N/tex and the tensile strength of the wire is in the range from 1 to 4 G Pa.

10. A multifilament pintle wire as claimed in claim 1, wherein the pintle wire comprises 25% or more by weight of polyolefin material.

11. A multifilament pintle wire as claimed in claim 1, wherein the pintle wire comprises at least 40% by weight of polyolefin material.

12. A multifilament pintle wire as claimed in claim 1, wherein the pintle wire comprises at least 50% by weight of polyolefin material.

13. A multifilament pintle wire as claimed in claim 1, wherein the polyolefin material is gel-spun.

* * * * *